US006166699A

United States Patent [19]

Khammouni et al.

[11] Patent Number: 6,166,699

[45] Date of Patent: Dec. 26, 2000

[54] ANTENNA SOURCE FOR TRANSMITTING AND RECEIVING MICROWAVES

[75] Inventors: Alexi Khammouni, Saint-Hilaire; Jean-pierre Blot, Nice; Gérard Estrade, Muret; Jean-Claude Cruchon, Bouffemont, all of France

[73] Assignee: Alcatel, Paris, France

[21] Appl. No.: 09/081,515

[22] Filed: May 20, 1998

[30] Foreign Application Priority Data

May 21, 1997 [FR] France ..... 97 06172

[51] Int. Cl.[7] ..... H01P 1/213; H01Q 15/24

[52] U.S. Cl. ..... 343/756; 343/786; 333/126; 333/135; 333/21 A; 333/113

[58] Field of Search ..... 333/126, 135, 333/21 A, 113; 343/756, 786

[56] References Cited

U.S. PATENT DOCUMENTS

| | | | |
|---|---|---|---|
| 3,500,419 | 3/1970 | Leitner et al. | 333/126 X |
| 3,731,236 | 5/1973 | Di Tullio et al. | 343/756 X |
| 3,955,202 | 5/1976 | Young | 343/756 |
| 3,978,434 | 8/1976 | Morz et al. | 333/135 |
| 4,162,463 | 7/1979 | Di Tullio et al. | 333/126 X |
| 5,003,321 | 3/1991 | Smith et al. | 333/135 X |

FOREIGN PATENT DOCUMENTS

| | | | |
|---|---|---|---|
| 0041077A2 | 12/1981 | European Pat. Off. . | |
| 0518218A1 | 12/1992 | European Pat. Off. . | |
| 114156 | 9/1979 | Japan | 333/135 |
| 2117980 | 10/1983 | United Kingdom . | |
| 2194859 | 3/1988 | United Kingdom . | |

*Primary Examiner*—Benny T. Lee
*Attorney, Agent, or Firm*—Sughrue, Mion, Zinn, Macpeak & Seas, PLLC

[57] ABSTRACT

The invention relates to an antenna source transmitting and receiving polarized microwaves, the source including a transducer for separating the transmission signals from the reception signals, the frequencies of the transmission signals being different from the frequencies of the reception signals. The connection between the transducer and the radiating element of the antenna is such that it maintains the polarization states of the signal received by the radiating element and of the signal transmitted to said radiating element. The transducer comprises a square-section waveguide, one end of which is connected to the radiating element, the other end being connected to the transmission path, the received signals being conveyed by the side faces of the waveguide. This source makes it possible to transmit and to receive in the enlarged C band, i.e. 3.4 GHz to 4.2 GHz on reception, and 5.85 GHz to 6.65 GHz on transmission.

24 Claims, 3 Drawing Sheets

ANTENNA SOURCE FOR TRANSMITTING AND RECEIVING MICROWAVES

The invention relates to an antenna source for transmitting and receiving polarized microwaves.

BACKGROUND OF THE INVENTION

It is known that to transmit large quantities of information by means of radio signals, it is preferable to use broad-band polarized signals with high carrier frequencies.

In addition, when the same antenna serves both to transmit and to receive signals, it is necessary for the transmission frequency bands to be distinct from the reception frequency bands.

The ever increasing quantity of telecommunications traffic means that the transmission and reception frequency bands are being enlarged. For example, C band, used at present for certain satellite communications, and extending from 3.625 GHz to 4.2 GHz for reception and from 5.85 GHz to 6.425 GHz for transmission, is going to be expanded at its lower frequent limit for reception (3.4 GHz to 4.2 GHz) and at its upper frequency limit (5.85 GHz to 6.65 GHz) for transmission.

FIG. 1 is a diagram showing an antenna source that can be used for transmitting and receiving signals in conventional C band, i.e. with bandwidths of 575 MHz both for transmission and for reception. That known antenna source includes a radiating element such as a horn 10 connected via a matching section 12 and via a circular-section waveguide 14 to a polarizer 16 serving firstly to convert the received signals from circularly polarized signals into linearly polarized signals, and secondly to convert the signals to be transmitted from linearly polarized signals to circularly polarized signals.

The polarizer 16 is connected to a transducer 18 for separating the transmission frequencies from the reception frequencies. The transducer comprises a circular-section waveguide whose outside surface is provided with slots extending in the longitudinal direction—i.e. their long dimensions are parallel to the axis of the waveguide—and connected to other waveguides (not shown) and to filter means (not shown either) for blocking the transmission frequencies and passing the reception frequencies.

The end of the waveguide of the transducer 18 that is remote from its end connected to the polarizer 16 receives the signals to be transmitted. The transmission path includes filter means for blocking the reception frequencies and, in general, it also includes orthogonal polarization means.

It has been observed that an antenna source of that type does not give satisfactory results for transmitting and receiving broad-band signals, in particular for the above-mentioned expanded C band.

OBJECTS AND SUMMARY OF THE INVENTION

The invention makes it possible to remedy those drawbacks.

In the antenna source of the invention, to transmit and receive broad-band signals, the transducer separating the transmission signals from the reception signals comprises a square-section waveguide, or a waveguide of square or circular section (or of some other section) having ribs or corrugations extending perpendicularly to the propagation direction of the signals.

In the preferred embodiment, the transducer is connected to the transmission path by means of a circular-section waveguide penetrating into the waveguide of the transducer. This configuration makes it possible to optimize separation between the transmission signals and the reception signals. Separation is further improved if an iris, e.g. in the form of two slots, is provided at the end of the circular waveguide inside the waveguide of the transducer.

When the transducer comprises a square-section waveguide, each of its faces is advantageously provided with a rectangular aperture or slot whose long side is advantageously perpendicular to the axis of the waveguide. These slots make it possible to extract the reception signals; they are associated with filter means for blocking transmission frequencies.

In a preferred embodiment of the invention, the connection between the radiating element and the transducer that separates the transmission frequencies from the reception frequencies is such that it maintains the polarization states of the signals it conveys.

In which case, if the transmitted or received signals are to have their polarization states converted (circular to linear or linear to circular), a corresponding polarizer is provided in the transmission path and/or in the reception path, at the end of the transducer remote from the radiating element. This configuration also facilitates operation with broad transmission bands and broad reception bands.

When slots are provided making it possible to extract the reception signals from the waveguide of the transducer, the slots of two opposite faces are, in one embodiment, connected to respective ones of the inlets of an adder of the "magic tee" type. With the received signal being of circular polarization, the outlet of each of the adders delivers the reception signal with polarization that is linear in a determined direction, the outputs of the two magic tees being signals whose polarization vectors are mutually perpendicular.

To transform the signals having orthogonal linear polarizations characterizing the right and left circular polarizations in the source, use is advantageously made of a 3 dB/90° coupler, in particular of the "Riblet" type. Such a coupler comprises two waveguides of rectangular section which are connected together in a rectangular junction zone, each waveguide comprising an inlet branch leading to the junction zone and an outlet branch leading away from the junction zone. The height of the junction zone is equal to the short side of the section of each of waveguides and the width of the junction zone is twice the long side of said section. Generally, to match the amplitudes of the signals in the outlet branches, at least one projection is provided projecting from a large wall inside the junction zone.

In another configuration of the invention, to optimize the polarization separation performed by the coupler, i.e. to obtain signals that are phase separated by 90° and that are of equal amplitude, e.g. to within 0.1 dB, over a broad frequency band, such a coupler is used in which the junction zone has a projection that is elongate in the "transverse" direction extending transversely to the propagation direction, on at least one large wall.

In known Riblet couplers, the corresponding projections in the junction zone are either circular or elongate in the longitudinal direction.

With a projection that is elongate in the transverse direction results are obtained that are significantly better than with known couplers, i.e. the output signals are matched in amplitude over a broader frequency band.

Even better results are obtained when the projection is extended by ribs directed towards respective ones of the branches of the waveguides, each of the ribs preferably having a height that decreases progressively inside each branch.

For transmission, when it is necessary to transmit right circularly polarized signals and/or left circularly polarized signals on the basis of linearly polarized signals, a duplexer is used that receives the transmitted signals with orthogonal linear polarizations, and a polarizer is used which transforms the linearly polarized signals into circularly polarized signals.

It is also possible to use a "septum" type polarizer which combines the functions of duplexer and polarizer. Such a polarizer comprises two waveguides of semicircular section receiving linearly polarized signals, and converging towards a circular-section outlet waveguide. In the outlet waveguide, as from the junction zone where the inlet waveguides meet, a wall or blade is provided that extends in a longitudinal direction and is of decreasing height in the radial direction. This wall extends along the axis of the outlet waveguide. The height of the blade decreases progressively, i.e. preferably in stages, i.e. in steps. It has been observed that better results are obtained with such steps, and that the number of steps has an influence on the passband of the polarizer. In general, the higher the number of steps, the broader the passband of the polarizer.

BRIEF DESCRIPTION OF THE DRAWINGS

Other characteristics and advantages of the invention appear from the following description of some of its embodiments given with reference to the accompanying drawings, in which.

DESCRIPTION OF PREFERRED EMBODIMENTS

The embodiment of the invention described below with reference to the figures concerns an antenna source for transmitting and receiving in the enlarged C band. As indicated above, for reception, the frequencies lie in the range 3.4 GHz to 4.2 GHz, and for transmission, the frequencies lie in the range 5.85 GHz to 6.65 GHz. In other words, the reception frequency band extends over 800 MHz. The same applies to the transmission frequency band.

Figure 1:
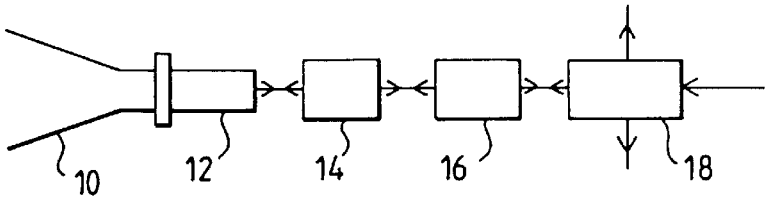
FIG. 1 (PRIOR ART)
FIG. 1, described above, shows a prior state of the art.
Figure 2:
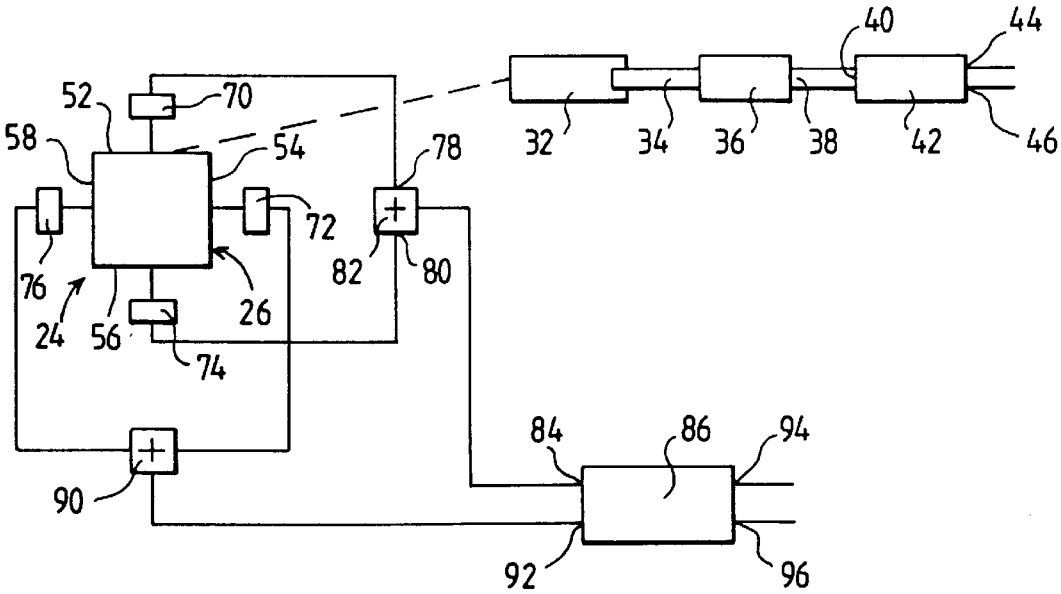
FIG. 2 is an overall diagram of an antenna source of the invention.

The antenna source shown in FIG. 2 includes a transducer 24 (also shown in FIG. 3) comprising a square-section waveguide 26 and shown in cross-section in the figure, i.e. in section perpendicular to the propagation axis. One end of the waveguide 26 is connected directly to a propagation horn (not shown). The term "directly" is used to mean that the transducer 24 is not connected to the propagation horn or to any other radiating member via a polarizer. The connection may however include a non-radiating element other than a polarizer, e.g. a mode extractor serving to servo-control an antenna that has to track the trajectory of a satellite.

The end 30 (FIG. 3) of the waveguide 26 that is remote from its end 28 connected to the horn is connected to a circular-section waveguide 32 that receives, via a square-section waveguide 34, the right circularly polarized transmission signals and the left circularly polarized transmission signals delivered by a polarizer 36 (FIG. 2).

The purpose of the polarizer 36 is to transform the linearly polarized input signals into circularly polarized output signals. Thus, the inlet 38 (FIG. 2) of the polarizer 36 is connected to the outlet 40 of a duplexer 42 having two inlets, respectively 44 and 46, receiving linearly polarized signals that are to be transformed into right circularly polarized signals and left circularly polarized signals. The inlet 44 receives the signals that are to be transformed into right circularly polarized signals, and the inlet 46 receives the signals that are to be transformed into left circularly polarized signals.

In a preferred embodiment of the invention, the duplexer 42 and the polarizer 36 form a single element 50 constituting a polarizer of the "septum" type which is described further on in the text below with reference to FIGS. 5 and 6.

Figure 3:
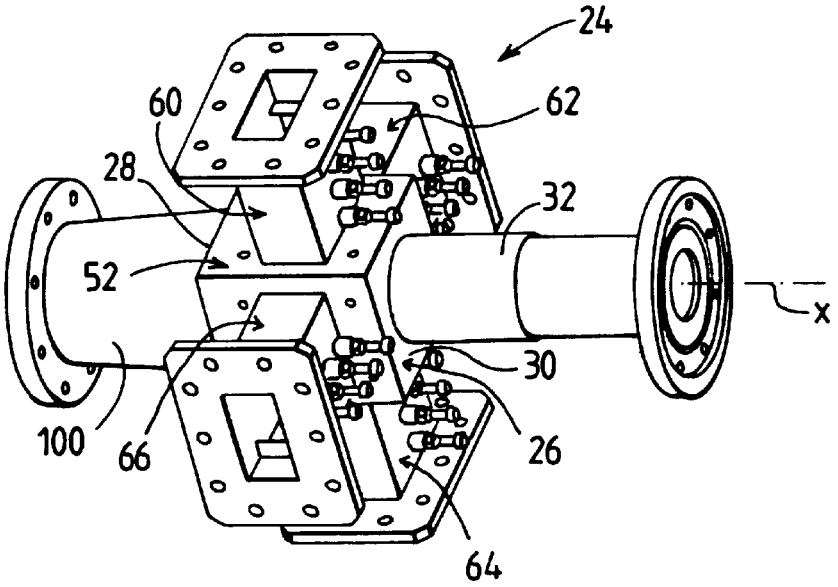
FIG. 3 is a perspective view showing a transducer that is part of the source shown in FIG. 2.

The side faces 52, 54, 56, and 58 (FIG. 2) of the waveguide 26 are provided with rectangular apertures or slots to which small waveguides of the same rectangular section are connected. As shown in FIG. 3, the face 52 is extended by the rectangular waveguide 60. The waveguides 60, 62, 64, and 66 (FIG. 3) are at the same position along the axis x of the waveguide 26. It is important to note that the long dimension of each of the slots, and therefore of each of the rectangular waveguides 60, 62, 64, and 66 is perpendicular to the axis x. In other words, the rectangular apertures extend transversely relative to the propagation direction.

The waveguides 60, 62, 64, and 66 are equipped with respective filters 70, 72, 74, and 76 (FIG. 2), for stopping the transmission frequencies and passing the reception frequencies.

The rectangular waveguides associated with the opposite faces 52 and 56 of the waveguide are connected to respective ones of the two inlets 78 and 80 of a "magic tee" 82 (FIG. 2) whose outlet is connected to the first inlet 84 of a coupler 86 of the 3 dB/90° type.

Likewise, the rectangular waveguides associated with the opposite faces 54 and 58 are connected to respective ones of the inlets of a second "magic tee" 90 whose outlet is connected to the second inlet 92 of the coupler 86.

Via its first inlet, the coupler 86 receives a signal that is linearly polarized in a first direction, and, via its second inlet, it receives a signal that is linearly polarized in an orthogonal direction. These signals are the right circularly polarized component and the left circularly polarized component of the wave in the source. At respective ones of its outlets 94 and 96, the coupler delivers signals that represent and distinguish between the two orthogonal circular polarizations. For example, the signal at the outlet 94 represents the right circular polarization, and the signal at the outlet 96 represents the left circular polarization. An example of such a coupler is described further on in the text below with reference to FIGS. 7 to 9.

It should be noted that the fact that separate polarizers are provided for transmission and for reception makes it possible to optimize the polarizers and to make an antenna source for receiving and transmitting signals in the enlarged C band.

The square sections of the waveguides 26 also contribute to broadening the transmission band and the reception band.

In a variant (not shown), the inside face of the waveguide 26 is provided with corrugations, i.e. ribs extending perpendicularly to the axis x. In another variant, the transducer 24 comprises a circular-section waveguide instead of the square-section waveguide 26, the circular-section waveguide also being provided with corrugations making it possible to make the band broader than with a waveguide not provided with such corrugations.

Figure 4:
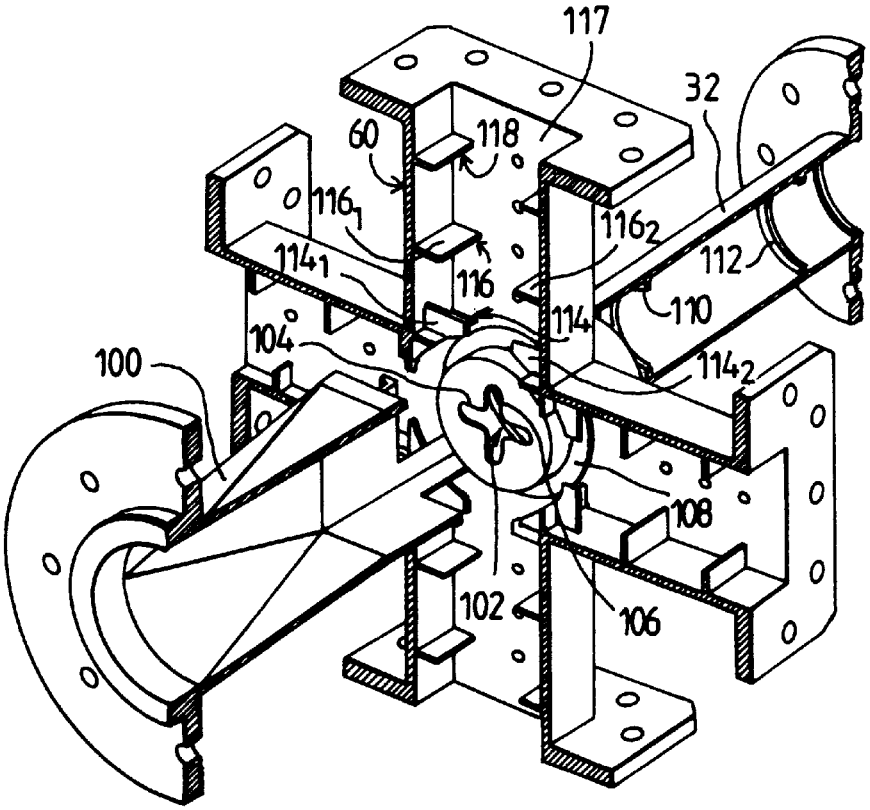
FIG. 4 is a perspective view showing the inside of the transducer shown in FIG. 3.

Reference is now made to FIGS. 3 and 4.

The waveguide 26 is connected via its front face 28 to a waveguide 100 (FIGS. 3 and 4) serving as a transition between the square-section waveguide 26 and the circular-section waveguide of the horn.

The circular-section waveguide 32 for connecting the transmission path is terminated inside the waveguide 26 by an iris 102 which, in this example, is cross-shaped, i.e. it comprises two perpendicular slots 104 and 106. The iris 102 short-circuits the reception frequencies.

A ring 108 is provided behind the iris 102, and against the inside face of the wall 30. The purpose of the ring 108, in association with the iris 102, is to reflect the reception signals towards the slots in the side walls of the waveguide 26 and thus to prevent the reception signals from penetrating into the transmission path.

The circular waveguide 32 of the transmission path is provided with other irises 110, 112 in the form of rings for impedance-matching purposes for the transmission frequencies lying in the range 5.85 GHz to 6.65 GHz.

Irises 114, 116, and 118 are also provided in each small waveguide of rectangular section of the reception path, e.g. in the waveguide 60 (FIG. 4). Each of the irises 116 and 118 is formed of two rectangular plates or ribs projecting from the inside faces of the short sides of the waveguides 60. These ribs, referenced $\mathbf{116}_1$ and $\mathbf{116}_2$ for the iris 116, are perpendicular to the large faces 117 of the waveguide 60.

In contrast, the iris 114 that is the closest to the corresponding slot (not shown in FIG. 4) of the waveguide 26 is formed of two plates $\mathbf{114}_1$ and $\mathbf{114}_2$ also perpendicular to the small faces of the waveguide 60 but parallel to the large faces 117.

The irises 114, 116, and 118 constitute the filter means making it possible to stop the transmission frequencies and to pass the reception frequencies.

Figure 5:
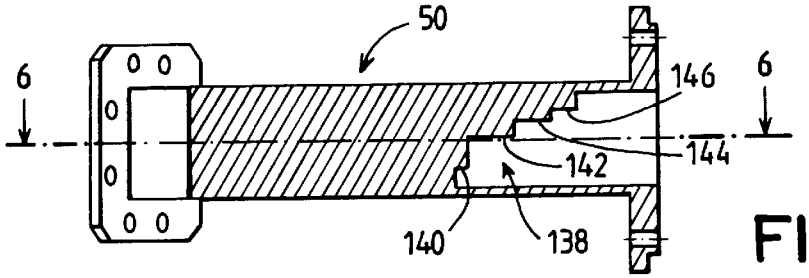
FIG. 5 is a view in section through a polarizer serving for the transmission path of the antenna source shown in FIG. 2.
Figure 6:
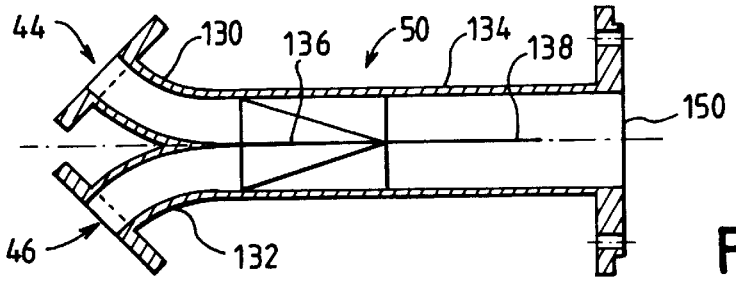
FIG. 6 is a view in section on line 6—6 of FIG. 5.

Reference is now made to FIGS. 5 and 6 which show a septum polarizer situated in the transmission path of the antenna shown in FIG. 2.

The septum-type polarizer 50 includes two inlet waveguides 130 and 132 (FIG. 3). The inlet 44 is situated at the end of the waveguide 130 and the inlet 46 is situated at the end of the waveguide 132 (FIGS. 2 and 6). In the vicinity of the inlets, the waveguides are of rectangular section, and thereafter they are of semi-circular section.

The two waveguides 130 and 132 are connected continuously to a circular-section waveguide 134 whose diameter is equal to the diameter of the section of each of the semi-circular waveguides 130 and 132. In the waveguide 134, as from the interconnection zone in which the waveguides 130 and 132 are connected together, a central wall or blade 136 (FIG. 6) is provided whose plane contains the axis of the waveguide 134. In the interconnection zone in which the waveguides 130 and 132 are connected together, the height of the central wall in the radial direction is equal to the inside diameter of the waveguide 134. Towards the outlet zone 138, the width of the wall 136 decreases in stages, i.e. end section is provided with steps. In the example shown, four steps are provided, respectively 140, 142, 144, and 146 (FIG. 5).

Linearly polarized signals are applied to the inlets 44 and 46 (FIG. 6), which signals are transformed at the outlet 150 into circularly polarized signals. The signals applied to the inlet 44 are transformed into right circularly polarized signals and the signals applied to the inlet 46 are transformed into left circularly polarized signals.

In the enlarged C band, the quality of the circular polarization, i.e. its ellipticity, depends on the way the end 138 is cut away, in particular on the number of steps and the length (in the axial direction) and the height (in the radial direction) of each of the steps. In particular, it is has been observed that the higher the number of steps, the broader the passband of the polarizer. It may also be noted that the lengths and the heights of the steps are not equal.

Figure 7:
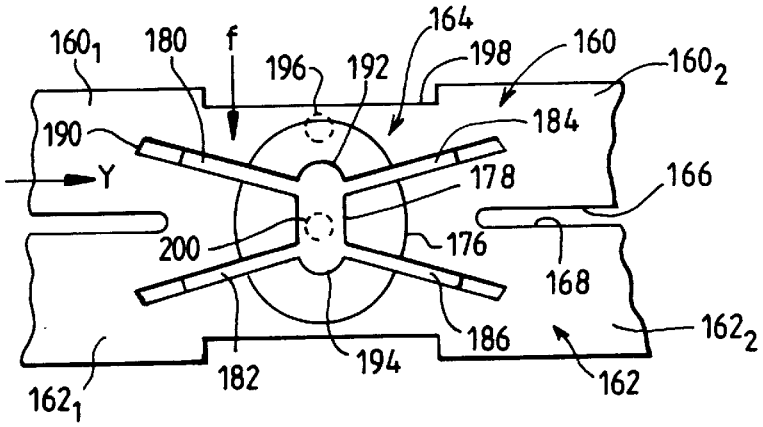
FIG. 7 is a diagram showing the inside of a 3 dB/90° coupler used as a polarizer in the reception path of the source shown in FIG. 2.
Figure 8:
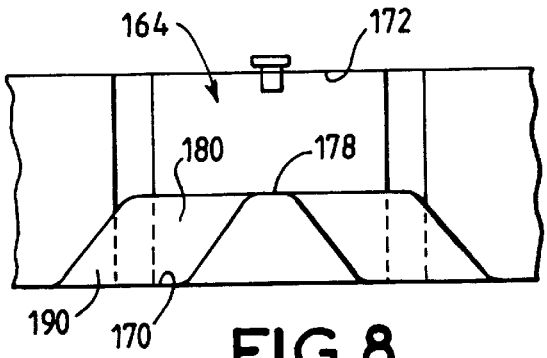
FIG. 8 is a view looking along arrow f of the coupler shown in FIG. 7.
Figure 9:
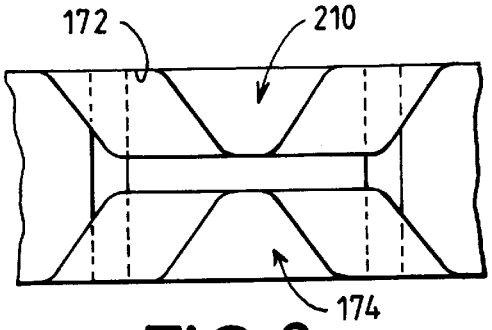
FIG. 9 is a view similar to the FIG. 8 view, but for a variant.

Reference is now made to FIGS. 7 to 9 which show an embodiment of the coupler 86 in the reception path. In known manner, a 3 dB/90° coupler of the "Riblet" type (FIG. 2) is such that a signal applied to the inlet 84 is delivered in the form of two signals of equal amplitude at the outlets 94 and 96, the output signals being phase-shifted by 90° relative to each other. Similarly, a signal applied to the second inlet 92 is delivered in the form of two signals of equal amplitude at the outlets 94 and 96 and with a phase-shift of 90° between the output signals.

Such a coupler includes two waveguides 160 and 162 (FIG. 7) which are connected together in a junction zone 164. The waveguides are of rectangular section, and they are disposed such that their small faces 166 and 168 corresponding to the short sides of the section are adjacent, and such that, in a junction zone 164, said faces or walls are omitted.

The junction zone has a floor-forming wall 170 and a ceiling-forming wall 172 (FIG. 8). The width of each of these walls, i.e. the dimension perpendicular to the propagation direction Y (FIG. 7) and parallel to the large faces of the waveguides 160 and 162, is equal to twice the largest dimension of the rectangular section of each waveguide 160, 162. The height of the junction zone, i.e. the distance between the walls 170 and 172 is equal to the short side of the section of the waveguides 160 and 162.

The floor-forming wall 170 is provided with a projection 174 whose base 176 has a shape that is curved and elongate transversely to the propagation direction Y (FIG. 7). The base 176 of the projection 174 occupies a large portion (about 75%) of the area of the floor 170. The vertex 178 of the projection 174 is of dimensions significantly smaller than those of the base 176. The vertex is also elongate transversely to the propagation direction Y. The base and the vertex of the projection are centered relative to the junction zone 164.

The projection 174 is extended by ribs, respectively 180, 182, 184, and 186. For the purposes of simplification, only one of the ribs (the rib referenced 180) is described, the other ribs being analogous.

The rib 180 is constituted by a wall perpendicular to the floor 170. Inside the junction zone 164, the height of the rib 180 is the same as the height of the projection 174. The rib 180 is directed towards the inlet branch $\mathbf{160}_1$ of the waveguide 160 and it penetrates in part into said branch $160_1$. Its height decreases progressively in said branch. In other words, the end of the rib 180 is in the shape of a wedge or bevel 190. At the opposite end from the bevel 190, the rib 180 is connected to that end 192 of the vertex 178 of the projection 174 which faces towards the waveguide 160.

The rib 184 is directed towards the outlet branch $160_2$ of the waveguide 160. The rib 182 is directed towards the inlet branch $162_1$ of the waveguide 162, and the rib 186 is directed towards the outlet branch $162_2$ of the same waveguide 162. The ribs 182 and 186 are connected together via that end 194 of the vertex 178 of the projection which is remote from the end 192 via which the other ribs 180 and 184 are connected together.

An adjustment screw 196 is provided in the ceiling 172 in the vicinity of its edge 198. Another adjustment screw 200 is situated at the center of the ceiling. These screws make it possible to adjust the coupling between the outgoing waves, i.e. to adjust the relative amplitudes of the waves.

It has been observed that the projection 174 that is elongate transversely to the signal propagation direction Y makes it possible to keep the amplitudes of the output signals equal to within 0.1 dB over a broad frequency band and, in any event, over the 800 MHz of the reception C band. The ribs 180, 182, 184, and 186 significantly further improve the quality of the coupler over the desired bandwidth.

The dimensions of the zone 164 are of the same order of magnitude as the dimensions of the corresponding zone of a conventional Riblet coupler. In known manner, the properties of the coupler result from the fact that the $TE_{10}$ and $TE_{20}$ modes co-exist in the junction zone 164.

But with the invention, the $TE_{10}$ mode is transformed into a U-shaped $TE_{10}$ mode, thereby giving it a steadier guided wavelength $\lambda_G$ and a broader operating band associated with the dimensions of the U.

In the embodiment shown in FIG. 9, the ceiling 172 of the junction zone 164 is provided with a projection 210 that is analogous to the projection 174, and that is also extended by four ribs analogous to the corresponding ribs associated with the projection 174. The dimensions and the dispositions of the projection 210 and of the associated ribs are the same as those of the projection 174 and of its corresponding ribs.

In a variant, the projection 174 and optionally the projection 210 are not constituted by continuous elements, but rather by respective sets of projections such as studs that are close enough together to impart the same result as a continuous projection.

In a variant, the polarizer 86 is omitted, the reception signal being used in linear polarization. The received signals are thus recovered at the outlets of the magic tees 82 and 90.

Likewise, in a variant, for transmission, only a duplexer 42 is provided and not a polarizer 36, transmission being performed with signals having orthogonal linear polarizations.

For transmission, it is also possible to make provision to use a duplexer and a polarizer rotated through 90°, transmission then being performed with signals having orthogonal linear polarizations.

In a further variant, the source is provided with a number of accesses that is lower than the four accesses provided in the examples described above (two transmission accesses, and two reception accesses). In which case, the unused accesses are loaded.

The antenna source described is particularly applicable to telecommunications antennas of diameter lying in the range 1 meter to 32 meters or more.

What is claimed is:

1. An antenna source for transmitting and receiving microwaves, the antenna source including a transducer (24) for separating transmission signals from reception signals, the transmission signals having frequencies different from frequencies of the reception signals, wherein the transducer (24) comprises a square-section waveguide (26), one end of the square-section waveguide being connected to a radiating element, and another end of the square-section waveguide being connected to a signal transmission path, the transmission path including a circular-section waveguide (32) that terminates inside the square-section waveguide (26);

wherein the transmission path is connected to the waveguide of the transducer via filter means passing signals at transmission frequencies and reflecting signals at reception frequencies; and wherein the filter means comprise a ring situated inside the waveguide of the transducer.

2. The source according to claim 1, wherein, in the transmission path, a septum-type polarizer is provided for transforming linearly polarized signals into right and left circularly polarized signals.

3. The source according to claim 1, wherein the frequencies of the transmission signals are in a range of 5.85 GHz to 6.65 GHz.

4. The source according to claim 1, wherein the reception signals are transmitted by side faces of the waveguide of the transducer.

5. The source according to claim 1, wherein a reception path of the reception signals path includes waveguides connected to side faces of the waveguide of the transducer via apertures or slots that are elongate transversely to a signal wave propagation direction.

6. The source according to claim 1, wherein the frequencies of the reception signals are in a band ranging from 3.4 GHz to 4.2 GHz.

7. A source according to claim 1, wherein the waveguide of the transmission path is provided with an iris.

8. The source according to claim 7, wherein said iris is in the form of two slots situated inside the waveguide of the transducer.

9. The source according to claim 1, wherein the connection between the transducer and the radiating element maintains polarization states of the reception signals received by the radiating element and of the transmission signals transmitted to said radiating element.

10. The source according to claim 9, wherein two opposite side faces of the square-section waveguide of the transducer are connected to two inlets of a first summing circuit, and wherein the other two opposite side faces of the waveguide of the square-section transducer are connected to inlets of a second summing circuit, outlets of the first and second summing circuits delivering signals having mutually orthogonal linear polarizations.

11. The source according to claim 9, wherein a polarizer, for transforming linearly polarized signals into circularly polarized signals, is disposed in a signal reception path.

12. The source according to claim 11, wherein the polarizer comprises a 3 dB/90° coupler.

13. An antenna source for transmitting and receiving microwaves, the antenna source including a transducer (24) for separating transmission signals from reception signals, the transmission signals having frequencies different from frequencies of the reception signals, wherein the transducer (24) comprises a square-section waveguide (26), one end of the square-section waveguide being connected to a radiating element, and another end of the square-section waveguide being connected to a signal transmission path, the transmission path including a circular-section waveguide (32) that terminates inside the square-section waveguide (26);

wherein the connection between the transducer and the radiating element maintains polarization states of reception signals received by the radiating element and of the transmission signals transmitted to said radiating element, said source including, in a signal reception path, a polarizer for transforming linearly polarized signals into circularly polarized signals;

wherein the polarizer comprises a 3 dB/90° coupler; and wherein the 3 dB/90° coupler comprises two waveguides which are of rectangular section, and which have inlet branches and outlet branches that are connected together in a rectangular junction zone having a height that is equal to a short side of the section of the two waveguides and a width that is twice a long side of the section of the two waveguides, and wherein at least one of a ceiling-forming wall and a floor-forming wall of the junction zone has an inwardly-directed projection that is elongate transversely to a signal wave propagation direction.

14. The source according to claim 13, wherein the projection has a base, having a large area which occupies a majority of the area of a corresponding wall of the junction zone, and a smaller vertex.

15. The source according to claim 14, wherein the vertex of the projection occupies a central position in the junction zone.

16. The source according to claim 13, wherein the projection is secured to ribs directed towards respective ones of the inlet branches and the outlet branches of the two waveguides of the coupler.

17. The source according to claim 16, wherein the ribs and the projection have respective heights which are substantially the same.

18. The source according to claim 16, wherein each rib has an end which penetrates into a respective branch, and wherein the end thereof penetrating into the respective branch has a height that decreases progressively going from the junction zone towards the respective branch.

19. The source according to claim 16, wherein the ribs directed towards a first of said two waveguides are connected together via a vertex of the projection via a first end thereof directed towards the first waveguide, whereas the ribs directed towards the inlet branches and the outlet branches of the second of said two waveguides are connected together via the vertex of the projection via a second end thereof.

20. The source according to claim 13, wherein, in the junction zone of the coupler, adjustment means are provided for adjusting the coupling between output signals.

21. An antenna source for transmitting and receiving microwaves, the antenna source including a transducer (24) for separating transmission signals from reception signals, the transmission signals having frequencies different from frequencies of the reception signals, wherein the transducer (24) comprises a square-section waveguide (26), one end of the square-section waveguide being connected to a radiating element, and another end of the square-section waveguide being connected to a signal transmission path, the transmission path including a circular-section waveguide (32) that terminates inside the square-section waveguide (26);

wherein, in the transmission path, a septum-type polarizer is provided for transforming linearly polarized signals into right and left circularly polarized signals; and wherein the polarizer comprises two semi-circular section inlet waveguides connected together to a circular-section outlet waveguide having an axial separation wall extending from an interconnection zone in which the outlet waveguide is connected to the inlet waveguides and terminated going towards an outlet of the outlet waveguide by an end zone in which the height of the wall decreases in steps.

22. The source according to claim 21, wherein the heights of the respective steps, in a radial direction, are not equal.

23. The source according to claim 21, wherein a passband of the polarizer depends on the number of said steps at the end zone of the wall.

24. The source according to claim 21, wherein the lengths of the respective steps, in the axial direction, are not equal.

* * * * *